United States Patent [19]

McCarthy

[11] Patent Number: 5,012,946

[45] Date of Patent: May 7, 1991

[54] INNERSEAL FOR A CONTAINER AND METHOD OF APPLYING

[75] Inventor: Theresa A. McCarthy, West St. Paul, Minn.

[73] Assignee: Minnesota Mining & Manufacturing Company, St. Paul, Minn.

[21] Appl. No.: 546,669

[22] Filed: Jun. 29, 1990

Related U.S. Application Data

[63] Continuation of Ser. No. 314,394, Feb. 27, 1989, abandoned.

[51] Int. Cl.[5] ..... B65D 77/20; B65D 51/20

[52] U.S. Cl. ..... 220/258; 215/232; 220/270; 220/359

[58] Field of Search ..... 215/232, 250; 220/258, 220/265, 270, 359; 229/3.5 MF, 125.33, 125.34, 125.35

[56] References Cited

U.S. PATENT DOCUMENTS

| | | | |
|---|---|---|---|
| 713,824 | 11/1902 | White, Jr. . | |
| 745,195 | 11/1903 | Kimsey . | |
| 756,601 | 4/1904 | Doremus . | |
| 830,735 | 9/1906 | Olsson . | |
| 895,719 | 8/1908 | Bradley . | |
| 902,843 | 11/1908 | Sheppard . | |
| 1,073,071 | 9/1913 | Hall . | |
| 2,050,248 | 8/1936 | Eisen . | |
| 2,077,992 | 4/1937 | Eisen . | |
| 2,131,775 | 10/1938 | Waring . | |
| 2,188,946 | 2/1940 | Gutmann . | |
| 2,620,939 | 12/1952 | Weisgerber . | |
| 2,646,183 | 7/1953 | Pellett . | |
| 2,925,188 | 2/1960 | Grumbles | 215/232 X |

(List continued on next page.)

FOREIGN PATENT DOCUMENTS

| | | |
|---|---|---|
| 040797 | 5/1981 | European Pat. Off. . |
| 045262 | 7/1981 | European Pat. Off. . |
| 109592 | 4/1983 | European Pat. Off. . |
| 109593 | 4/1983 | European Pat. Off. . |
| 111900 | 12/1983 | European Pat. Off. . |

(List continued on next page.)

OTHER PUBLICATIONS

"Increase Packaging Efficiency and Package Performance", DuPont Co., Polymer.

"Cap-Seal ® Closure Liners", 2-p. Brochure from 3M Packaging Systems Division.

"There's a Unipac Induction Seal Just Right for Every Application", 1-p. Brochure from Insulec, Ltd.

Mylar ® for Packaging -Summary of Properties, 2 p. Brochure from DuPont.

*Primary Examiner*—Stephen Marcus

*Assistant Examiner*—Nova Stucker

*Attorney, Agent, or Firm*—Merchant, Gould, Smith, Edell, Welter & Schmidt

[57] ABSTRACT

An easily removable innerseal for a container and method of application relates to an improved arrangement having a body portion adapted for fitting over the upper rim of a container and a flexible element attached to the body portion for a user to grip. The body portion is provided with a lower bonding layer, which includes a first bonding portion and a second bonding portion adhered to the first portion, and a layer to prevent fluid from passing therethrough. The bonding force between the first and second bonding portions is designed to be weaker than the bonding force between the bonding layer and the container. In addition, the rupture strength of the first bonding portion is less than either of the bonding forces. As a result, the force required to remove the innerseal from the container is not dependent upon the amount of heat applied during sealing, because delamination will occur between the two bonding portions in an area over the container rim, leaving a residue of the first adhesive portion attached to the rim. By gripping the flexible element and pulling it upwardly, a user can remove the innerseal from the container without having to puncture or scrape the innerseal with a sharp object, which is frequently required to remove innerseals of the type commonly in use today. The method of application includes the steps of applying the body portion of the innerseal around the rim portion of a container and passing the container through an induction type heating station.

16 Claims, 5 Drawing Sheets

U.S. PATENT DOCUMENTS

| | | | |
|---|---|---|---|
| 2,937,481 | 5/1960 | Palmer . | |
| 3,032,225 | 5/1962 | Harding . | |
| 3,202,308 | 8/1965 | Botkin . | |
| 3,317,068 | 5/1967 | Betner . | |
| 3,330,720 | 7/1967 | Stevens et al. | 215/347 X |
| 3,389,827 | 6/1968 | Abere et al. . | |
| 3,391,847 | 7/1968 | Christine et al. | 220/359 X |
| 3,489,307 | 1/1970 | Wenger . | |
| 3,501,042 | 3/1970 | Risch et al. . | |
| 3,549,440 | 12/1970 | Adcock et al. . | |
| 3,565,247 | 2/1971 | Brochman . | |
| 3,632,004 | 1/1972 | Grimes | 215/232 |
| 3,637,101 | 1/1972 | Risch et al. . | |
| 3,767,076 | 10/1973 | Kennedy | 215/232 |
| 3,892,351 | 7/1975 | Johnson et al. | 220/359 X |
| 3,900,125 | 8/1975 | Wyler et al. . | |
| 3,923,198 | 12/1975 | Brochman . | |
| 3,928,109 | 12/1975 | Pollock et al. | 215/349 X |
| 3,963,845 | 6/1976 | Dukess . | |
| 3,964,415 | 6/1976 | Viker et al. . | |
| 3,973,719 | 8/1976 | Johnson et al. | 220/359 X |
| 3,990,603 | 11/1976 | Brochman . | |
| 4,013,188 | 3/1977 | Ray | 215/347 |
| 4,044,941 | 8/1977 | Knudsen . | |
| 4,089,434 | 5/1978 | Tagalakis et al. . | |
| 4,108,330 | 8/1978 | Patterson . | |
| 4,121,728 | 10/1978 | Tagalakis et al. . | |
| 4,135,637 | 1/1979 | Hannula . | |
| 4,155,439 | 5/1979 | Fletcher et al. . | |
| 4,163,506 | 8/1979 | Patterson . | |
| 4,189,060 | 2/1980 | Trotman, III . | |
| 4,209,126 | 6/1980 | Elias | 215/232 |
| 4,215,791 | 8/1980 | Brochman . | |
| 4,256,234 | 3/1981 | Mori et al. . | |
| 4,256,528 | 3/1981 | Patterson . | |
| 4,270,665 | 6/1981 | Kunimoto et al. | 215/347 |
| 4,311,247 | 1/1982 | Dembicki et al. | 215/232 |
| 4,315,047 | 2/1982 | Seabold et al. . | |
| 4,324,601 | 4/1982 | Dembicki et al. . | |
| 4,330,353 | 5/1982 | Kunimoto et al. | 215/347 X |
| 4,372,460 | 2/1983 | Brochman et al. . | |
| 4,373,978 | 2/1983 | Patterson . | |
| 4,378,074 | 3/1983 | Brochman . | |
| 4,381,848 | 5/1983 | Kahn | 229/3.5 MF |
| 4,390,552 | 6/1983 | Niwa . | |
| 4,396,655 | 8/1983 | Graham et al. | 215/232 X |
| 4,405,056 | 9/1983 | Patterson . | |
| 4,418,834 | 12/1983 | Helms et al. | 220/359 |
| 4,423,819 | 1/1984 | Cummings . | |
| 4,424,911 | 1/1984 | Resnick . | |
| 4,436,213 | 3/1984 | Paul, Jr. et al. . | |
| 4,442,129 | 4/1984 | Niwa et al. . | |
| 4,445,620 | 5/1984 | Brochman et al. . | |
| 4,448,326 | 5/1984 | Brochman . | |
| 4,451,526 | 5/1984 | Claude et al. | 215/232 X |
| 4,454,956 | 6/1984 | Patterson . | |
| 4,462,502 | 7/1984 | Luenser et al. . | |
| 4,463,116 | 7/1984 | Koyama et al. . | |
| 4,469,754 | 9/1984 | Hoh et al. . | |
| 4,500,011 | 2/1985 | Brochman . | |
| 4,501,371 | 2/1985 | Smalley . | |
| 4,514,248 | 4/1985 | Cummings | 215/232 X |
| 4,526,562 | 7/1985 | Knudsen et al. . | |
| 4,527,703 | 7/1985 | Cummings . | |
| 4,537,327 | 8/1985 | Lu . | |
| 4,557,505 | 12/1985 | Schaefer et al. . | |
| 4,564,121 | 1/1986 | Brochman . | |
| 4,565,738 | 1/1986 | Purdy . | |
| 4,576,297 | 3/1986 | Larson . | |
| 4,577,777 | 3/1986 | Brochman . | |
| 4,579,240 | 4/1986 | Ou-Yang . | |
| 4,588,099 | 5/1986 | Diez . | |
| 4,595,114 | 6/1986 | Lu . | |
| 4,595,434 | 6/1986 | Eckstein et al. . | |
| 4,596,338 | 6/1986 | Yousif . | |
| 4,625,875 | 12/1986 | Carr et al. . | |
| 4,650,082 | 3/1987 | Paciorek . | |
| 4,666,052 | 5/1987 | Ou-Yang . | |
| 4,673,601 | 8/1987 | Lamping et al. | 220/258 |
| 4,684,554 | 8/1987 | Ou-Yang . | |
| 4,693,390 | 9/1987 | Hekal | 220/359 |
| 4,722,447 | 2/1988 | Crisci . | |
| 4,733,786 | 3/1988 | Emslander . | |
| 4,735,335 | 4/1988 | Torterotot . | |
| 4,754,890 | 7/1988 | Ullman et al. . | |
| 4,757,914 | 7/1988 | Rath et al. | 220/359 X |
| 4,778,698 | 10/1988 | Ou-Yang . | |
| 4,801,041 | 1/1989 | Takata et al. | 220/260 X |

FOREIGN PATENT DOCUMENTS

| | | | |
|---|---|---|---|
| 128434 | 5/1984 | European Pat. Off. . | |
| 135431 | 8/1984 | European Pat. Off. . | |
| 1246995 | 4/1964 | Fed. Rep. of Germany . | |
| 1281677 | 2/1965 | Fed. Rep. of Germany . | |
| 2622012 | 5/1976 | Fed. Rep. of Germany . | |
| 2922047 | 12/1979 | Fed. Rep. of Germany | 220/359 |
| 3311170 | 3/1983 | Fed. Rep. of Germany . | |
| 2327161 | 10/1975 | France . | |
| 209616 | 7/1940 | Switzerland . | |
| 659633 | 12/1978 | Switzerland . | |
| 283050 | 1/1928 | United Kingdom . | |
| 1495386 | 12/1973 | United Kingdom . | |
| 1511250 | 11/1974 | United Kingdom . | |
| 1576373 | 3/1977 | United Kingdom . | |
| 1536428 | 12/1978 | United Kingdom . | |
| 2052726 | 7/1979 | United Kingdom . | |
| 2072131 | 3/1981 | United Kingdom . | |
| 2177974 | 7/1986 | United Kingdom . | |

INNERSEAL FOR A CONTAINER AND METHOD OF APPLYING

This is a continuation of application Ser. No. 314,394, filed Feb. 27, 1989, now abandoned.

BACKGROUND OF THE INVENTION

1. Field of the Invention

This invention relates to container innerseals, which are used in conjunction with a conventional threaded-on cap to provide an airtight, hermetically closed seal for containers. More specifically, the invention relates to an improved innerseal for a container which promotes ease of removal in conjunction with improved sealability for containers on which it is applied relative those innerseals which were heretofore known.

2. Description of the Prior Art

In view of the need in contemporary society for airtight, hermetically closed seals on containers for food, medicine and the like, closures have been developed which incorporate an innerseal bonded with an adhesive to an upper container rim. To effect such a seal, a filled container after being capped is passed through an electromagnetic field generated by induction heating equipment, which heats a foil layer within the innerseal, thereby bringing about the melting of a heat sealable polymeric film coating. One system of this type which has met with significant commercial success bears the trademark "Safe-Gard", and is manufactured by the Minnesota Mining and Manufacturing Company of St. Paul, Minn. This system provides a hermetic seal that is suitable for use with ingestible commodities. The seal is particularly effective for products which should be preferably kept free from contamination, oxidation and/or moisture. However, it is difficult to effectively control the adhesive force by which such innerseals are bonded to the containers, due to the dependency of the sealing force on the amount of inductive power that is applied. Accordingly, it has previously been necessary to maintain strict control over the amount of power that is applied during sealing of such containers, and a wide range of seal tightness may result even if the power range is effectively controlled. Moreover, the amount of sealing force which could be used was limited by the fact that a proportional amount of force was needed to remove the innerseal from the container by the end user. As a result such seals had to be penetrated or scraped off with a sharp implement such as a knife. This problem was compounded by the inconsistency of sealing forces from container to container and the limitations on sealing force as discussed above.

Although innerseals which have integral tab portions for gripping purposes have been developed, as is disclosed in U.S. Pat. No. 4,754,890 to Ullman et al., the basic problem of grippability in conjunction with a limited and unpredictable range of sealing forces has not been effectively solved to date. It is within this context that the present invention assumes significance.

It is clear that there has existed a long and unfilled need in the prior art for container innerseals which are easily removable by an end user without scraping or puncturing, and that have a consistent removal force which allows a strong seal to be provided between the innerseal and container regardless of the sealing force, and that obviates the need for strict control during the sealing process.

SUMMARY OF THE INVENTION

According to the invention, a sealed container of the type which is provided with a safety innerseal includes a container body having an upper rim; and an innerseal including a body portion adapted for fitting over the upper rim, the body portion including membrane structure for preventing passage of fluid through the body portion, structure adapted for bonding the body portion against the upper rim of the container; the bonding structure including a first bonding portion which is bonded to the rim with a first bonding force and a second bonding portion which is adhered to the first bonding portion with a second bonding force, the second bonding force being less than the first bonding force, the first bonding portion having a rupture strength that is less than either of the second bonding force and the first bonding force, and gripping structure attached to an outer periphery of the body portion whereby the sealing structure will delaminate internally during removal from a container.

According to a second aspect of the invention, a method for forming a sealed container of the type which includes a safety innerseal includes the steps of providing a container body having an upper rim; placing an innerseal constructed as detailed above over the upper rim; and passing the container and innerseal through a heating station, whereby the innerseal is sealed onto the container body to form a tight, effective closure.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
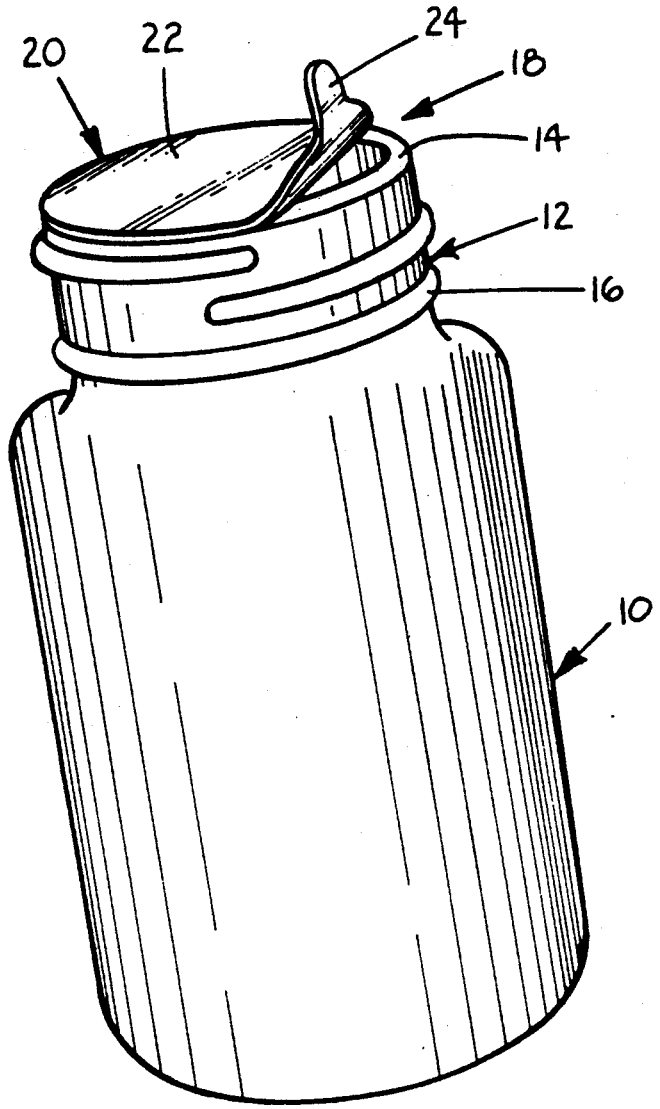
FIG. 1 is a perspective view of a sealed container constructed according to a first preferred embodiment of the invention.

Referring to the drawings, wherein corresponding structure is identified by like reference numerals throughout the views, and particularly referring to FIG. 1, a container 10 having a neck portion 12 and a rim 14 includes a raised helical thread 16 formed upon neck portion 12 over which an appropriate sealing cap with mating threads may be applied, as is known throughout the art.

A sealing arrangement 18 is provided for bonding an orifice defined in container 10 by rim 14. Sealing arrangement 18 includes a removable innerseal 20 having a circular body portion 22 and a flexible tab portion 24, as is shown in FIG. 1. Body portion 22 is sized so as to extend over the full extent of the orifice and over rim 14. Tab portion 24 is connected to body portion 22 at an outer peripheral edge thereof, as is shown in FIG. 1, and in the preferred embodiment is formed from the same continuously extending layered material as is body portion 22.

Common to all of the below described embodiments is a sealing or bonding layer which includes a first bonding portion and a second bonding portion. The first bonding portion adheres to rim 14 with a first bonding force, and to the second bonding portion with a second bonding force which is less than the first bonding force. The first bonding portion has a rupture strength that is less than either of the first or second bonding forces. The sealing layer is adhered to the remainder of the body portion with a third bonding force that is greater than the second bonding force.

Figure 2:
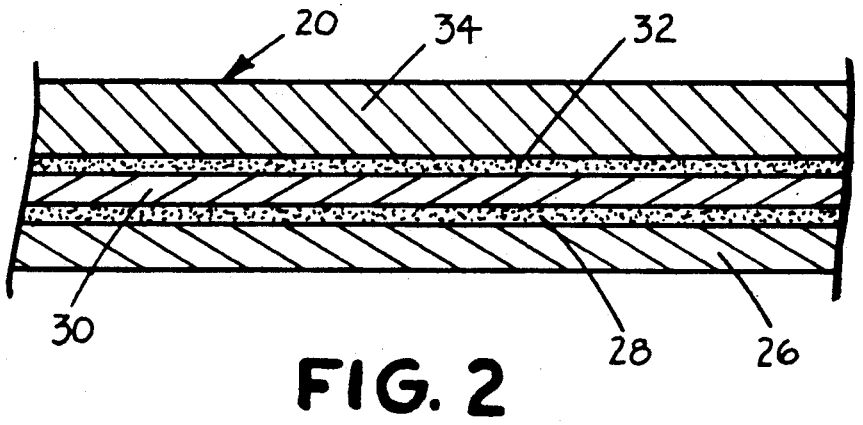
FIG. 2 is a fragmentary cross-sectional view through an innerseal portion of the container illustrated in FIG. 1.

FIG. 2 is a fragmentary cross-sectional view of the layers which together form innerseal 20. A first bonding portion such as a sealing layer 26 of heat sealable material is provided on a lower surface of innerseal 20 for bonding to the upper rim 14 of container 10. In the preferred embodiment, sealing layer 26 is formed of a multilayer polymeric film such as polyethylene or polyester and has a thickness of between 0.5–4 mils (0.0127–0.102 mm). Most preferably, the thickness of sealing layer 26 is approximately 1 mil (0.0254 mm). Sealing layer 26 may alternatively be formed of polypropylene, ethylene vinyl acetate copolymer (EVA) or a similar heat sealable material having relatively low tensile and shear strengths. Laminated to a top surface of sealing layer 26 is a second bonding portion such as a layer 28 of pressure sensitive adhesive (PSA). Layer 28 may for example be formed of Adcote 503A which is available from Morton Norwich Products, Inc. of Chicago, Ill.

The layer 28 of adhesive causes sealing layer 26 to adhere to a layer 30 of fluid impervious material. Layer 30 is in the preferred embodiment formed of a metallic foil. Most preferably, layer 30 is formed of aluminum foil having a thickness of between 1 and 2 mils (0.0254–0.051 mm).

A reinforcement layer 34 is laminated to layer 30 via a layer 32 of laminated adhesive, which for example may be formed of Adcote 503A. Reinforcement layer 34 is in the preferred embodiment formed of polyester and has a thickness of between 0.5–20 mils (0.0127–0.508 mm). Preferably, reinforcement layer 34 is between 2–4 mils (0.051–0.101 mm). Alternatively, reinforcement layer 34 may be formed of paper, polyethylene, a polymeric foamed sheet material or an equivalent material having a relatively high strength against tearing. An example of a paper which has been found suitable for reinforcement layer 34 is 80 lb. bleached Kraft paper from Sorg Paper Co. of Middleton, Ohio. The weight of this paper is 80 lbs. per ream, which is equivalent to 130 grams/m$^2$. As a second alternative, reinforcement layer 34 could be formed from the class of materials known as non-woven woven fabrics such as Tyvek®, which is manufactured by DuPont Corporation. In the preferred embodiment, the various layers in innerseal 20 described above with reference to FIG. 2 extend throughout both the body portion 22 and the tab portion 24 of innerseal 20.

Two specific constructions of an innerseal constructed according to the embodiment of FIG. 2 and which have proven satisfactory in practice will now be detailed:

EXAMPLE 1

In this construction, which is suitable for use with containers 10 that are formed of polyester or polyvinyl chloride, sealing layer 26 is formed of a film of 50 OL-2 Mylar brand film, which consists of an upper layer having a thickness of 0.4 mils (0.01 mm) and a lower layer having a thickness of 0.1 mils (0.002 mm) which is bonded to the upper layer. Both the upper and lower layers are composed of polyester, and the lower layer is formulated to have a lower melting point than the upper layer for sealability. Adhesive layer 28 in this construction is formed of Adcote 503A adhesive, and layer 30 is formed of an aluminum foil having a thickness of approximately 1 mil (0.025 mm). Reinforcement layer 34 is formed of a polyester film having a thickness of approximately 2 mils (0.05 mm), and is bonded to layer 30 with an adhesive layer 32 formed of Adcote 503A adhesive, which is spread to a coating weight of 0.925–1.4 grains per 24 square inches (77.4–117.2 mg/200 cm$^2$. In this construction, it has been found that delamination occurs within sealing layer 26 when the innerseal is being removed from a container 10.

EXAMPLE 2

In this construction, sealing layer 26 is formed of Mylar 50-OL2 film which has a total thickness of approximately 0.5 mils (0.0127 mm) and is constructed in the manner described above with reference to Example 1. Layer 30 is formed of aluminum foil having a thickness of approximately 1 mil (0.025 mm) and is bonded to layer 26 with a layer 28 formed of Adcote 503A adhesive. Reinforcement layer 34 is formed of a polyethylene foam having a thickness of approximately 5 mils (0.127 mm), which is bonded to layer 30 with an adhesive layer 32 of Adcote 503A adhesive, which is spread to a coating weight of 0.925–1.4 grains per 24 square inches (77.4–117.2 mg/200 cm$^2$). In this construction, delamination during opening of the innerseal has also been found to occur within the sealing layer 26.

Figure 3:
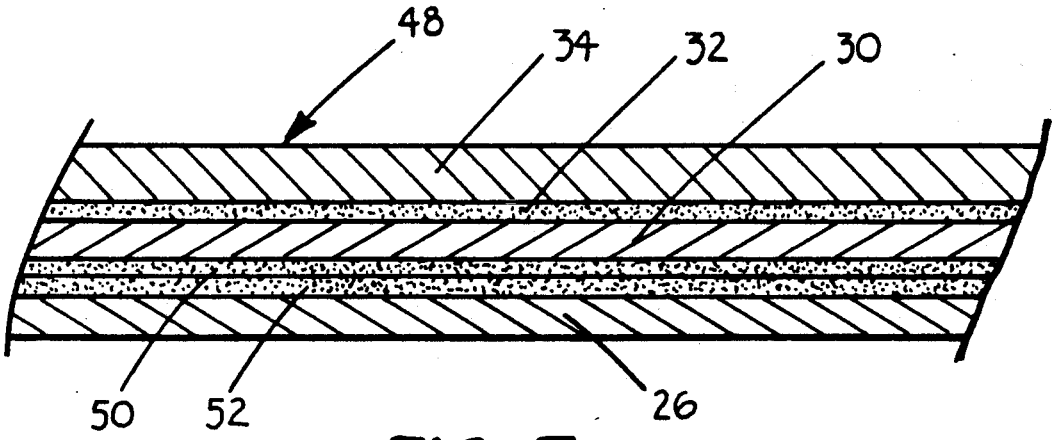
FIG. 3 is a fragmentary cross-sectional view through an innerseal constructed according to a second preferred embodiment of the invention.

FIG. 3 depicts in fragmentary cross-section a second embodiment 48 of an innerseal constructed according to the invention. Innerseal 48 includes a first bonding portion embodied as sealing layer 26, a fluid impervious layer 30, an adhesive layer 32 and a reinforcement layer 34 each of which correspond to those layers described above in reference to the embodiment of FIG. 2. However, innerseal 48 incorporates an adhesive primer layer 50 and a second bonding portion embodied as an adhesive layer 52 which together cause foil layer 30 to adhere to sealing layer 26. Adhesive layer 52 may for example be formed of Draton® 1107 adhesive, which is preferably spread to a coating weight of approximately 1–2 grains per each 24 square inches (83.7–167.4 mg/200 cm$^2$). Primer layer 50 is provided to cause adhesive layer 52 to adhere to fluid impervious layer 30 more strongly than it adheres to sealing layer 26. In this way, innerseal 48 is constrained to delaminate along the interface between adhesive layer 52 and sealing layer 26 when it is removed from a container 10. Primer layer 50 is preferably formed of a chlorinated polyolefin such as CP 343-1 primer, which is manufactured by the Eastman Chemical Corporation of Kingsport, Tenn.

Two examples of innerseal 48 which have been constructed and have proven to perform satisfactorily in practice will now be detailed:

EXAMPLE 3

In this construction, sealing layer 26 is formed of polyethylene film having a thickness of approximately 1 mil (0.025 mm). Adhesive layer 52 is formed of Kraton® 1107 adhesive and is spread to a coating weight of approximately 1 grain (83.7 mg/200 $cm^2$). Primer layer 50 is formed of Eastman CP 343-1 primer. Layer 30 is formed of aluminum foil having a thickness of approximately 1 mil (0.025 mm), and is joined to layer 34 by means of an adhesive layer 32 of Adcote 503A adhesive, which is spread to a coating weight of 0.925–1.4 grains per 24 $in^2$ (77.4–117.2 mg/200 $cm^2$). Reinforcement layer 34 is formed of a polyester film having a thickness of approximately 2 mils (0/05 mm).

EXAMPLE 4

In this construction, sealing layer 26 is formed of a polyethylene film having a thickness of approximately 1 mil (0.025 mm), which is adhered to a layer 30 of aluminum foil having a thickness of approximately 1 mil (0.025 mm) by a primer layer 50 formed of Eastman CP 343-1 primer and an adhesive layer 52 formed of Kraton® 1107, which is spread to a coating weight of approximately 1 grain (83.7 mg/200 $cm^2$). Reinforcement layer 34 is formed of a sheet of 80 lb./ream (130 $g/m^2$) Kraft paper having a thickness of approximately 6 mils (0.152 mm), which is bonded to layer 30 by an adhesive coating of Adcote 503A, which is spread to the coating weight described in Example 1.

Figure 4:
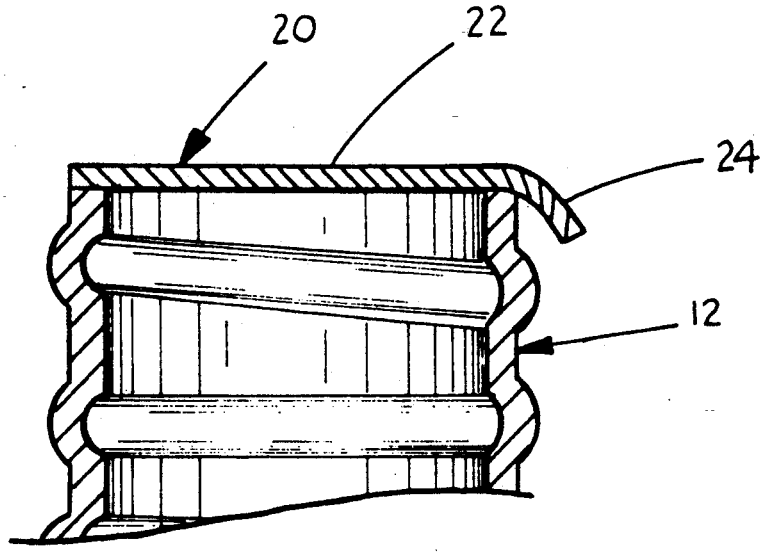
FIG. 4 is a cross-sectional view of the innerseal arrangement illustrated in FIG. 1.
Figure 5:
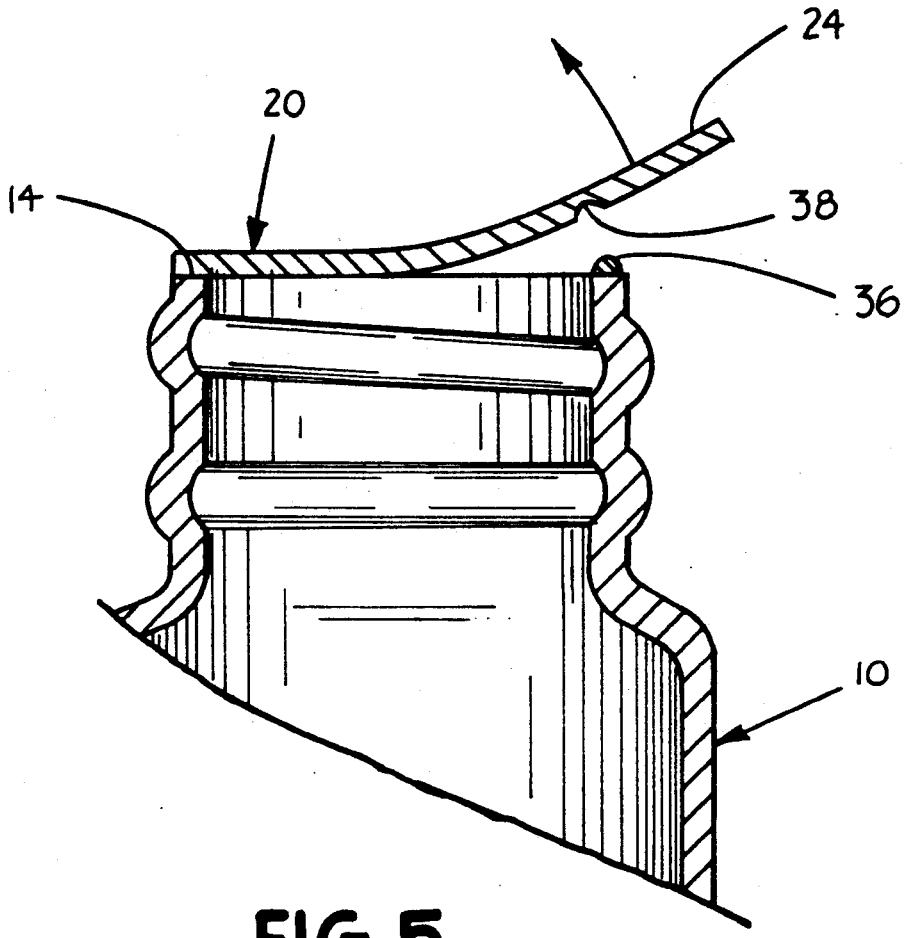
FIG. 5 is a cross-sectional view of the container illustrated in FIG. 1 depicting removal of the innerseal from the container.

Turning now to FIGS. 4 and 5, the removal of an innerseal 20, 48 from container 10 will be described. Innerseal 20 is sealed onto the rim portion 14 of container 10 in a manner which will be described below. To remove innerseal 20, 48 from its position around rim 14 as is shown in FIG. 4, the tab portion 24 is grasped and pulled upwardly. Because the adhesive layer is bonded to the sealing layer with a bonding force which is less than the bonding force between the sealing layer and the container rim, this movement initially results in delamination of adhesive layer 52 from sealing layer 26, in the portion of innerseal 20 which extends over rim 14. This delaminated area is depicted in FIG. 5 as a stripped surface 38. At this time, a portion 36 of seal material remains adhered to the rim 14. Because the rupture strength of sealing layer 26 is less than either of the abovementioned bonding forces, as tab portion 24 is pulled further upwardly, the sealing layer 26 is caused to rupture and then to tear progressively around the inner edge of rim 14, until the body portion 22 is completely removed from container 10. The delaminated layer 36 of seal material will remain adhered to rim 14 and will not interfere with removal of material from container 10.

In the case of an innerseal 20, delamination is caused to occur within sealing layer 26 when tab portion 24 is grasped and pulled upwardly. Where 50 OL-2 Mylar brand film is used to form sealing layer 26, delamination has been found to occur substantially along the interface between the two component layers of polyester within the film, with the exception that a certain amount of splitting occurs into the lower layer during delamination. For example, delamination might initially occur on the interface portion, deviate slightly into the lower layer of polyester, then return to the interface layer. The delaminated area which is caused to adhere to rim portion 14 is depicted in FIG. 5 as stripped surface 38. As is the case with innerseal 48, a portion 36 of seal material remains adhered to the rim 14. As top portion 24 is pulled further upwardly, the sealing layer 26 is caused to rupture and then to tear progressively around the inner edge of rim 14, until the body portion 22 is completely removed from container 10.

Because delamination occurs within the innerseal 20, 48 rather than directly between sealing layer 26 and rim 14, it is not necessary to maintain as strict a control over the amount of heat applied to sealing layer 26 during the sealing process, as was the case in innerseal designs previously known.

Figure 6:
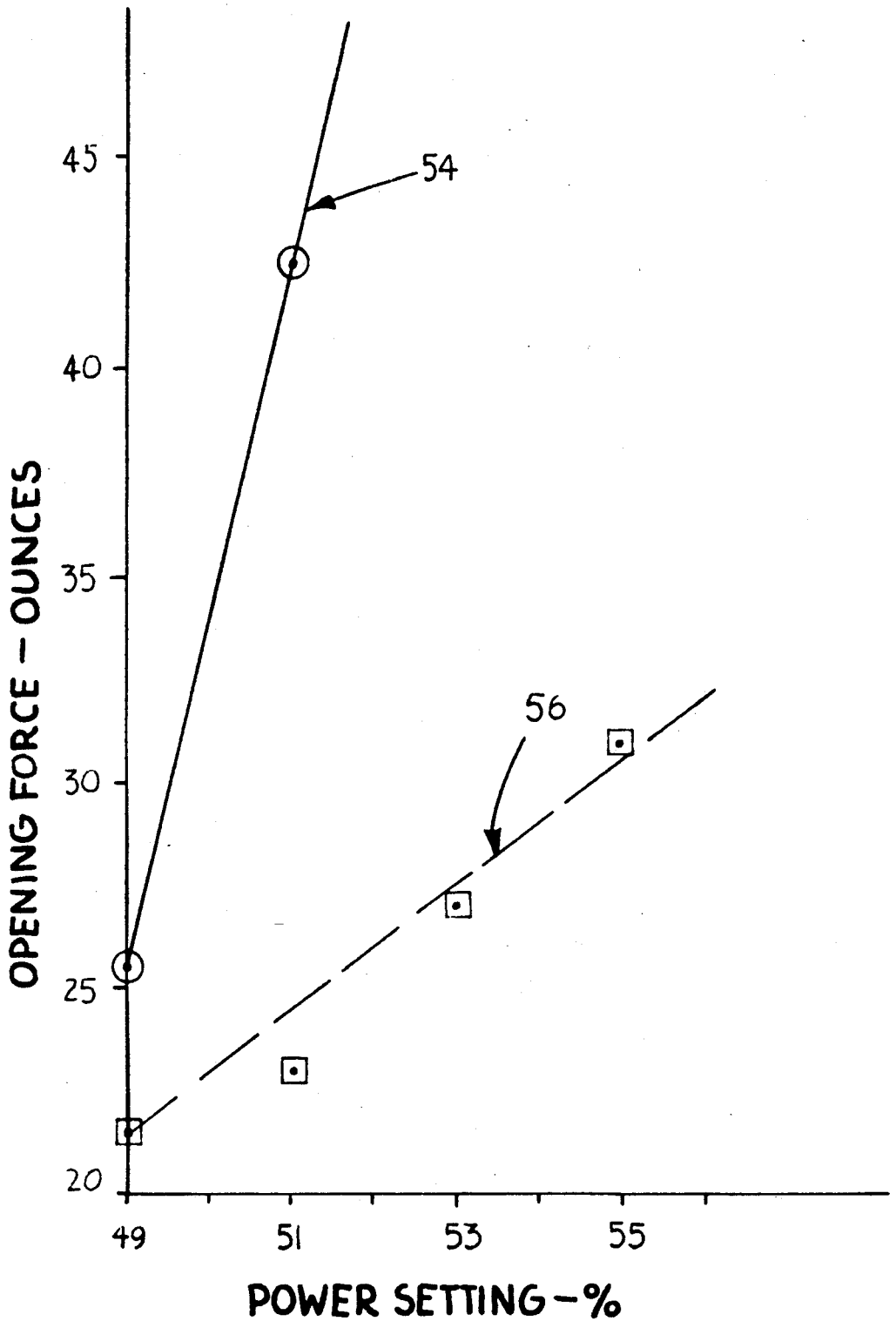
FIG. 6 is a graphical representation depicting opening force versus sealing power for the invention and a sealing arrangement which is previously known.

FIG. 6 provides a graphical representation of the advantages of the invention over a prior art arrangement. In FIG. 6, curve 54 depicts the force required to open a prior art innerseal having a single amorphous polyester adhesive layer, such as Vitel® PE 100, versus a power setting in an inductive heating station which is used to melt the adhesive layer onto a container. Vitel® PE 100 is commercially available from Goodyear Tire and Rubber Company of Akron, Ohio. Curve 56 depicts the force required to open an innerseal constructed according to Example 1 in the description of innerseal 20.

In the test for opening force which was used to produce the data shown in FIG. 6, a 4 ounce (118.3 ml) 43,410 finish continuous thread polyester bottle was used in conjunction with a 43,410 finish polypropylene cap. The bottle is available from Setco, Inc. of Anaheim, Calif., and the cap is available from Tubed Products, Inc. of Easthampton, Me. Each tested innerseal was positioned within the cap with the tab folded back between the cap and the innerseal, and with the heat sealable side of the innerseal facing the open end of the cap. The cap was tightened with a spring torque tester available from Owens Illinois Glass Co. of Toledo, Ohio to 20 inch-pounds (230.5 gram-meters). The innerseal was bonded to the bottle with a Lepel high frequency induction unit, Model No. T-2.5-1KC-APBW, made by Lepel High Frequency Laboratories, Inc. of New York City, N.Y. The power setting of the induction unit was varied, and is expressed in FIG. 6 as a percentage, to determine the effect on opening (removal) force.

After bonding, the bottle, cap, and innerseal were allowed to cool and the cap was removed. A 6 inch (152 mm) length of No. 898 filament tape available from Minnesota Mining and Manufacturing Company of St. Paul, Minn., was folded in half with the adhesive surfaces in contact with each other and each adhesive surface was adhered to opposing surfaces of the tab of the innerseal. The bottle was then clamped in the lower jaw of an Instron Model 1123 Tensile Tester so that the bottle is vertical. The filament tape was clamped in the upper jaw of the Instron tester. As the jaws of the Instron separate, the innerseal separates from the bottle and the level of force achieved at separation was recorded.

By comparing the two curves 54, 56, it may clearly be seen that a much wider range of power settings may be used in the present invention to keep opening force within a desired range than was possible for the prior art innerseal. Accordingly, it is possible to maintain a much higher level of quality control over the opening force of containers sealed with innerseals according to the invention.

Figure 7:
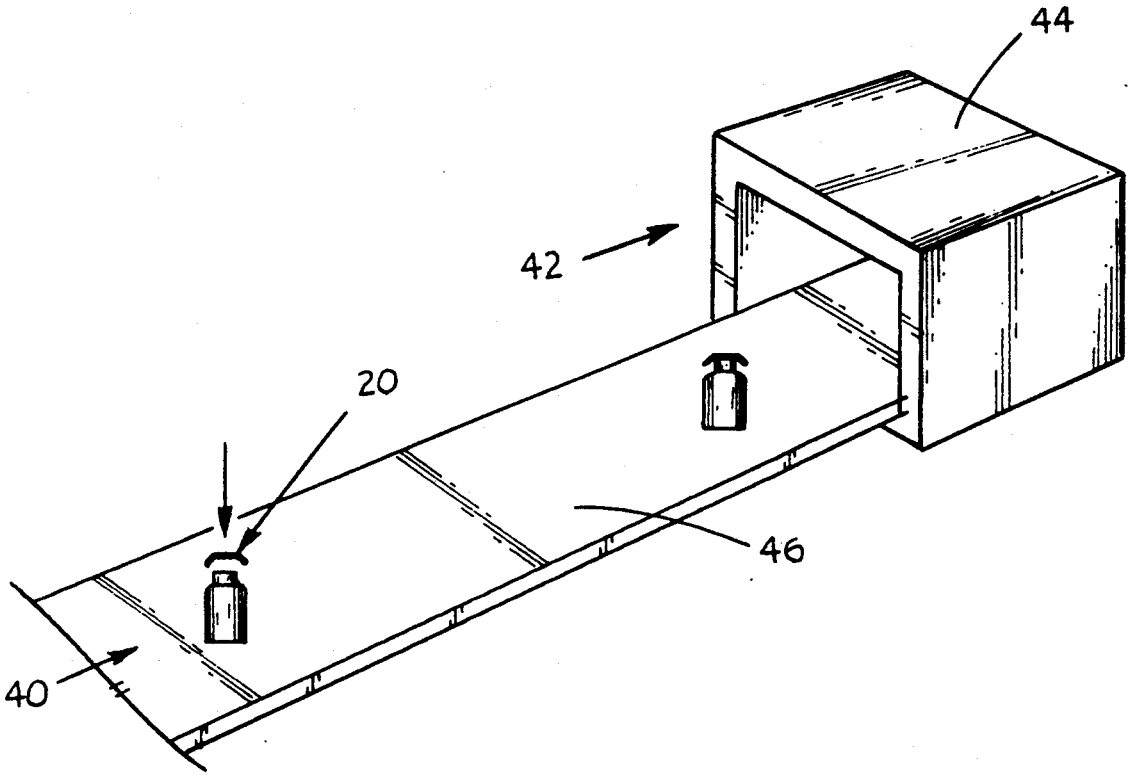
FIG. 7 is a perspective view of a work station for applying and sealing innerseals according to the invention.

Referring now to FIG. 7, the preferred process for applying an innerseal 20, 48 to a container will now be described. As is shown in FIG. 7, an innerseal 20, 48 is first placed over the opening in container 10 so that its peripheral edges extend over rim portion 14. This may be done directly, or by placing the innerseal 20, 48 within a threaded cap member and threading the cap member onto threads 16 of neck portion 14 so that the innerseal 20, 48 is forced against rim 14, in a manner that is known in the art. This process is depicted schematically in FIG. 7 at an application station 40. After application of innerseal 20, 48 to a container 10, the assembly is transported via a conveyor 46 or the like to a heat sealing station 42, which includes an induction heater 44. As the assembly consisting of bottle 10 and innerseal 20 passes through induction heater 44, the layer 30 of metallic foil is heated up, which in turn causes layer 26 to adhere to rim 14, effectively sealing innerseal 20 onto the neck portion 12 of container 10. The amount of heat applied to innerseal 20 must be sufficient to cause layer 26 to melt and adhere to rim 14 with more adhesive force than exists between layer 26 and PSA layer 52, for the reasons discussed above, and to ensure proper sealing of the container 10.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. An improved easy opening innerseal for use with a container of the type having an opening defined by an upper rim, comprising:

a body portion having an upper surface and adapted for fitting over an upper rim of a container, said body portion including membrane means for preventing passage of fluid through said body portion, said membrane means including an adhesive layer; and means adapted for bonding said body portion against the upper rim of the container; said bonding means having a first bonding stratum for bonding against the container rim with a first bonding force and a second bonding stratum which is bonded to said adhesive layer of said membrane means on one side and adhered to said first bonding stratum on an opposite side with a second bonding force which is less than said first boding force, said first boding stratum being fabricated of a material which has a rupture strength that is less than either of said second bonding force and said first bonding force; and gripping means attached to an outer periphery of said body means for a user to grip while removing said innerseal from a container, whereby a first part of said first bonding stratum will delaminate from said second bonding stratum over the container rim and remain adhered to the rim when said gripping means is pulled, while a second part of said first bonding stratum will remain adhered to said second bonding stratum, thereby exposing the opening.

2. An innerseal according to claim 1, wherein said membrane means comprises a fluid impermeable membrane.

3. An innerseal according to claim 2, wherein said membrane comprises a layer of aluminum foil.

4. An innerseal according to claim 1, wherein said first bonding strata has a lower melting temperature than said second bonding strata.

5. An innerseal according to claim 1, wherein said first bonding strata is comprised of a material selected from the group consisting essentially of polyester, polypropylene, polyethylene and EVA and laminates or blends thereof.

6. An innerseal according to claim 2, wherein said first bonding stratum portion comprises a layer of heat sealable film, and said second bonding stratum comprises a layer of pressure sensitive adhesive.

7. An innerseal according to claim 6, wherein said layer of heat sealable material comprises a material selected from the group consisting essentially of polyester, polypropylene, polyethylene and EVA and laminates or blends thereof.

8. An innerseal according to claim 1, wherein said gripping means and said body portion are formed of a continuously extending common layered material.

9. A sealed container of the type which is provided with a safety innerseal, comprising:

a container body having an upper rim; and an innerseal comprising a body portion for fitting over said upper rim, said body portion having an upper surface and including membrane means for preventing passage of fluid through said body portion, said membrane means including an adhesive layer, means adapted for bonding said body portion against said upper rim, said bonding means having a first bonding stratum for bonding against said container rim with a first bonding force and a second bonding stratum which is bonded to said adhesive layer of said membrane means on one side and adhered to said first bonding stratum on an opposite side with a second bonding force which is less than said first bonding force, said first bonding stratum being fabricated of a material which has a rupture strength that is less than either of said second bonding force and said first bonding force; and gripping means attached to an outer periphery of said body means for a user to grip while removing said innerseal from a container, whereby a first part of said first bonding stratum will delaminate from said second bonding stratum over the container rim and remain adhered to the rim when said gripping mean is pulled, while a second part of said first bonding stratum will remain adhered to said second bonding stratum, thereby exposing the opening.

10. An innerseal according to claim 9, wherein said membrane means comprises a fluid impermeable membrane.

11. An innerseal according to claim 10, wherein said membrane comprises a layer of aluminum foil.

12. An innerseal according to claim 9, wherein said first bonding strata has a lower melting temperature than said second bonding strata.

13. An innerseal according to claim 9, wherein said first bonding strata is comprised of a material selected from the group consisting essentially of polyester, polypropylene, polyethylene and EVA and laminates or blends thereof.

14. An innerseal according to claim 10, wherein said first bonding stratum comprises a layer of heat sealable film, and said second bonding stratum comprises a layer of pressure sensitive adhesive.

15. An innerseal according to claim 14, wherein said layer of heat sealable material comprises a material selected from the group consisting essentially of polyester, polypropylene, polyethylene and EVA and laminates or blends thereof.

16. An innerseal according to claim 9, wherein said gripping means and said body portion are formed of a continuously extending common layered material.

* * * * *

UNITED STATES PATENT AND TRADEMARK OFFICE

CERTIFICATE OF CORRECTION

PATENT NO. : 5,012,946

DATED : May 7, 1991

INVENTOR(S) : Theresa A. McCarthy

It is certified that error appears in the above-identified patent and that said Letters Patent is hereby corrected as shown below:

Col. 4, line 62, "Draton R" should read --Kraton®--.

Col. 8, Claim 6, line 17, delete "portion" after the word "stratum".

Col. 7, claim 1, line 57, "boding" should read --bonding-- (both occurrences)

Col. 8, claim 9, line 54, "mean" should read --means--.

Signed and Sealed this

Thirtieth Day of March, 1993

*Attest:*

STEPHEN G. KUNIN

*Attesting Officer*

*Acting Commissioner of Patents and Trademarks*